US007300501B2

(12) United States Patent
Hino et al.

(10) Patent No.: US 7,300,501 B2
(45) Date of Patent: Nov. 27, 2007

(54) ELECTROLESS GOLD PLATING LIQUID

(75) Inventors: Eiji Hino, Kitaibaraki (JP); Masashi Kumagai, Kitaibaraki (JP)

(73) Assignee: Nikko Materials Co., Ltd., Tokyo (JP)

( * ) Notice: Subject to any disclaimer, the term of this patent is extended or adjusted under 35 U.S.C. 154(b) by 139 days.

(21) Appl. No.: 10/549,537

(22) PCT Filed: Mar. 29, 2005

(86) PCT No.: PCT/JP2005/005936

§ 371 (c)(1),
(2), (4) Date: Sep. 15, 2005

(87) PCT Pub. No.: WO2005/098088

PCT Pub. Date: Oct. 20, 2005

(65) Prior Publication Data

US 2007/0095249 A1 May 3, 2007

(30) Foreign Application Priority Data

Apr. 5, 2004 (JP) ..... 2004-110630

(51) Int. Cl.
*C23C 18/44* (2006.01)

(52) U.S. Cl. ..... 106/1.23; 106/1.26

(58) Field of Classification Search ..... 106/1.23, 106/1.26

See application file for complete search history.

(56) References Cited

U.S. PATENT DOCUMENTS 5,232,492 A * 8/1993 Krulik et al. ..... 106/1.23
5,470,381 A * 11/1995 Kato et al. ..... 106/1.23
6,235,093 B1 * 5/2001 Okuhama et al. ..... 106/1.18

FOREIGN PATENT DOCUMENTS

| | | |
|---|---|---|
| JP | 5-78854 | 3/1993 |
| JP | 9-287077 | 11/1997 |
| JP | 11-12753 | 1/1999 |
| JP | 3148428 | 1/2001 |
| JP | 2003-268559 | 9/2003 |
| JP | 2004-137589 | 5/2004 |
| WO | WO 2004111287 A2 * | 12/2004 |

* cited by examiner

*Primary Examiner*—Helene Klemanski
(74) *Attorney, Agent, or Firm*—Flynn, Thiel, Boutell & Tanis, P.C.

(57) ABSTRACT

The object is to provide an electroless gold plating liquid which has an adequate deposition speed for practical use without containing any thallium or other heavy metal ions, excellent stability of the plating liquid and contains a non-cyanide gold salt as a gold salt, an alkali metal salt or an ammonium salt of sulfurous acid and thiosulfuric acid as a metal complexing agent, a hydroxyalkylsulfonic acid or a salt thereof represented by the following general formula as a reducing agent, and an amine compound, Chemical Formula 1 wherein R represents hydrogen, a carboxyl group, or any of a phenyl group, a tolyl group, a naphthyl group, a saturated or unsaturated alkyl group, an acetyl group, an acetonyl group, a pyridyl group and a furyl group which may have a substitutional group, X represents any of hydrogen, Na, K, and NH4, and n is an integer between 0 and 4.

4 Claims, No Drawings

ELECTROLESS GOLD PLATING LIQUID

TECHNICAL FIELD

The present invention relates to plating technology and specifically to an electroless gold plating liquid for obtaining a gold plated film generally with an Au thickness of 0.4 μm or more, which is required mainly in gold wire bonding and TAB.

BACKGROUND ART

As electronic parts, electronic devices and the like trend toward higher densities, electroless gold plating is coming into broader use, particularly since it is applicable to fine wiring. Reasons for this include the fact that circuits required for electrolytic plating around the object to be plated aren't needed because it is electroless, and the fact that it contributes to low-cost, simplified processes.

However, cyanide baths have been used conventionally for electroless gold plating liquids because of their stability, raising concerns about damages to the resist. Moreover, the high toxicity of cyanide electroless gold plating liquids has led to demands for non-cyanide processes, but baths such as sulfite baths that do not contain cyanide, for example, tend to decompose easily, and improvements are needed. Under these circumstances, non-cyanide electroless gold plating liquids have already been proposed.

Japanese Patent Documents 1 to 3 disclosed that an effective way for both bath stability and gold deposition speed of a non-cyanide electroless gold plating liquid is to use a mixed sulfite-thiosulfate complex system as a gold complexing agent and to use an urea compound such as thiourea as a reducing agent. However, when thiourea is used as a reducing agent, it is oxidized and a non-water-soluble cyanamide polymer is produced, causing problems of plate deposition failure. Therefore, as effective countermeasures, the addition of amine and carboxylic acid components for the aim of watersolubilizing the oxidation intermediate and addition of aliphatic saturated alcohol to suppress the autolysis of the thiourea reducing agent are proposed.

Moreover, Patent Document 4 states that the addition of a mercaptobenzothiazole compound with the aim of suppressing contamination by metal impurities and improving bath stability is useful when using the aforementioned mixed complexing agent together with ascorbic acid as the reducing agent, however, the reduction efficiency by ascorbic acid is poor, which needs to be added in excess to ensure a practical deposition speed (Patent Document 5). Patent Document 5 suggests the complexing agent system as described above, an aromatic compound typified by hydroquinone as a reducing agent system, and a heavy metal compound such as thallium nitrate in order to improve the deposition speed, but, the use of heavy metals, such as thallium, is desired to be substituted with other safer substances from the view point of toxicity, like cyanide.

Patent Document 1: Japanese Patent Publication No. H9-287077

Patent Document 2: Japanese Patent Publication No. H5-78854

Patent Document 3: Japanese Patent Publication No. H11-12753

Patent Document 4: Japanese Patent No. 3148428

Patent Document 5: Japanese Patent Publication No. 2003-268559

DISCLOSURE OF THE INVENTION

It is an object of the present invention to provide an electroless gold plating liquid which has an adequate deposition speed for practical use without containing thallium or other heavy metal ions, and which does not require a complicated bath composition or control such as the addition of a watersolubilizing agent or autolysissuppressing agent as thiourea reducing agents for example. It is also an object of the present invention to provide an electroless gold plating liquid which has an adequate deposition speed for practical use without containing thallium or other heavy metal ions, and which has a better plating liquid stability than thiourea reducing agents.

After exhaustive research aimed at solving the aforementioned problems, the present invention was achieved when it was discovered that excellent stability of the plating liquid and adequate deposition speed for practical use could be achieved by including, in an electroless gold plating liquid using a non-cyanide gold salt, an alkali metal salt or an ammonium salt of sulfurous acid and thiosulfuric acid as a complexing agent for gold, a specific hydroxyalkylsulfonic acid or a salt thereof as a reducing agent, and an amine compound. Thereupon the present invention is as follows:

(1) An electroless gold plating liquid comprising a non-cyanide gold salt as a gold salt, an alkali metal salt or an ammonium salt of sulfurous acid and thiosulfuric acid as a complexing agent for gold, a hydroxyalkylsulfonic acid or a salt thereof represented by the following general formula as a reducing agent, and an amine compound, Chemical Formula 1

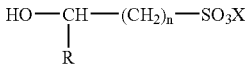

wherein R represents hydrogen, a carboxyl group, or any of a phenyl group, a tolyl group, a naphthyl group, a saturated or unsaturated alkyl group, an acetyl group, an acetonyl group, a pyridyl group and a furyl group which may have a substitutional group, X represents any of hydrogen, Na, K, and NH4, and n is an integer between 0 and 4.

(2) An electroless gold plating liquid according to (1) above wherein the reducing agent represented by said general formula is sodium hydroxymethanesulfonate ($HOCH_2SO_3Na$).

(3) An electroless gold plating liquid according to (1) or(2) above, wherein the non-cyanide gold salt is sodium gold sulfite.

(4) An electroless gold plating liquid according to any one of (1) through (4) above, wherein said amine compound is ethylenediamine or glycine.

(5) A gold plated product produced by using an electroless gold plating liquid according to any one of (1) through (4) above.

BEST MODE FOR CARRYING OUT THE INVENTION

The electroless gold plating liquid of the present invention is explained in detail below.

There are no particular limits on the non-cyanide gold salt used as the gold source in the present invention as long as it is water-soluble: the most important feature is to involve an alkali metal salt or an ammonium salt of sulfurous acid and thiosulfuric acid as the complexing agent for gold, the aforementioned specific hydroxyalkylsulfonic acid or a salt thereof as the reducing agent, and an amine compound.

As the non-cyanide water-soluble gold salts, chloroaurates, gold thiosulfates, gold thiomalates, and gold sulfites are exemplified. Of these, a gold sulfite is used by preference. Alkaline metal salts and ammonium salts are preferred as salts, and sodium gold sulfite is more preferred. The plating liquid contains the non-cyanide water-soluble gold salt preferably at a gold concentration of 0.1 to 10 g/L, more preferably 3 to 5 g/L. If the gold concentration is less than 0.1 g/L, the gold deposition rate will be much slower, while there is no advantage to be more than 10 g/L because the effects reach saturation.

A mixed complexing agent of sulfite-thiosulfate is used as the complexing agent for gold, and preferably 0.01 mol/L to 0.5 mol/L of the thiosulfuric acid salt is included, since at less than 0.01 mol/L the plating liquid is unstable and liable to decompose, while above 0.5 mol/L the effects on the plating reaction reach saturation. The content of the sulfurous acid salt is preferably 0.1 mol/L to 1.0 mol/L, since below 0.1 mol/L the plating bath is unstable and liable to decompose, while more than 1.0 mol/L is undesirable from a practical standpoint because the plating speed decreases. Alkali metal salts and ammonium salts are desirable as salts.

A hydroxyalkylsulfonic acid or a salt thereof represented by the following general formula is used as the reducing agent:

Chemical Formula 2

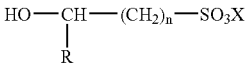

wherein R represents hydrogen, a carboxyl group, or any of a phenyl group, a tolyl group, a naphthyl group, a saturated or unsaturated alkyl group, an acetyl group, an acetonyl group, a pyridyl group and a furyl group which may have a substitutional group, X represents any of hydrogen, Na, K, and NH4, and n is an integer between 0 and 4.

In the aforementioned formula, examples of the substitutional group in the phenyl group, tolyl group, naphthyl group, saturated or unsaturated alkyl group, acetyl group, acetonyl group, pyridyl group and furyl group of R include a halogen atom, an alkoxy group, a nitro group, a hydroxyl group and a sulfonic acid group or a salt thereof and a phenyl group and an acetyl group and the like. Chlorine is desirable as the halogen atom, and a lower alkoxy group such as methoxy group is desirable as the alkoxy group. Salts of a sulfonic acid group include alkali metal salts or the like, and a sodium salt is preferred.

An alkyl group with 1 to 4 carbon atoms is desirable as the saturated or unsaturated alkyl group. Moreover, sodium is desirable as X in the above formula.

Specific examples of the hydroxyalkylsulfonic acid or a salt thereof represented by the aforementioned general formula include the following compounds or the like for example, and in particular the compounds of No. 1 and No. 2 can be used by preference.

[Chemical Formula 3]

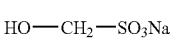

1

-continued

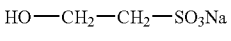

2

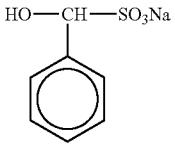

3

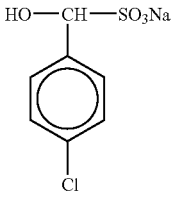

4

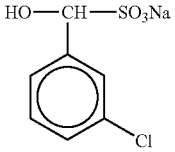

5

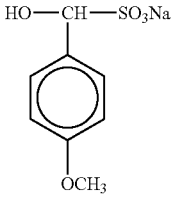

6

[Chemical Formula 4]

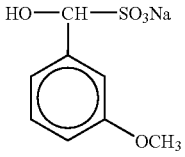

7

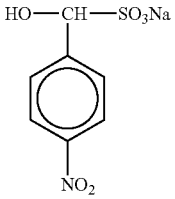

8

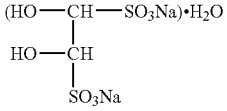

9

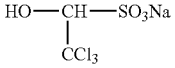

10

-continued
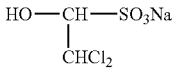
11
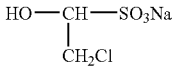
12
[Chemical Formula 5]
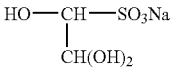
13
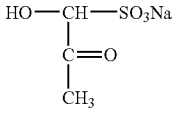
14
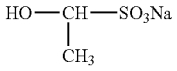
15
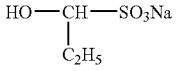
16
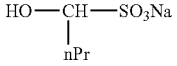
17
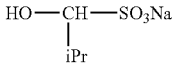
18
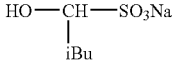
19
[Chemical Formula 6]
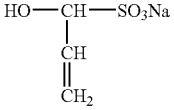
20
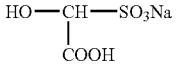
21
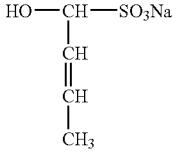
22
-continued
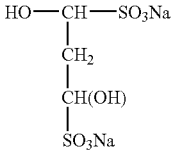
23
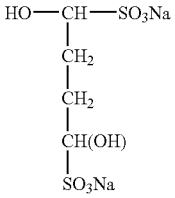
24
[Chemical Formula 7]
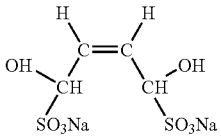
25
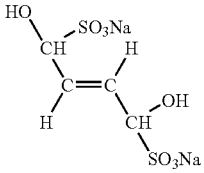
26
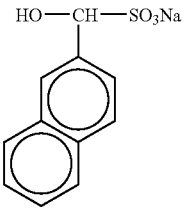
27
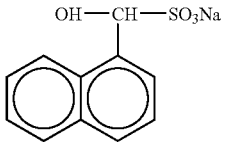
28
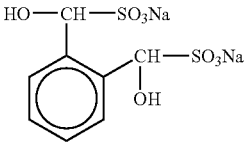
29

[Chemical Formula 8]
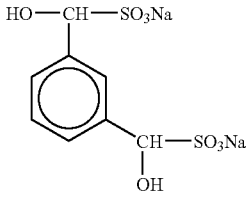
30
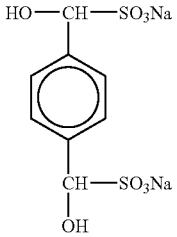
31
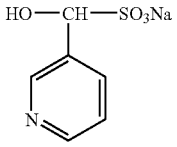
32
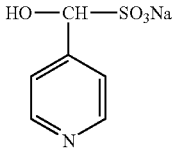
33
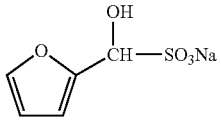
34
[Chemical Formula 9]
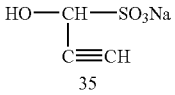
35
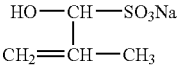
36
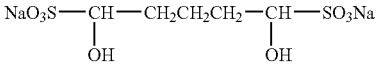
37
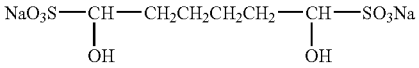
38
-continued
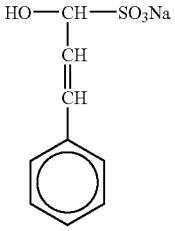
39
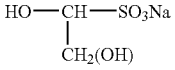
40
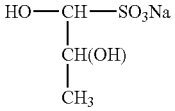
41
[Chemical Formula 10]
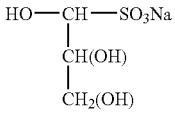
42
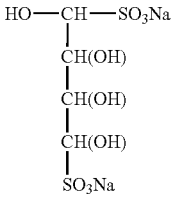
43
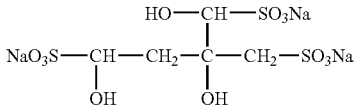
44
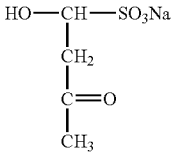
45
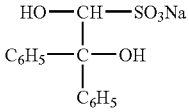
46
The plating liquid contains preferably 0.001 mol/L to 0.1 mol/L, or more preferably 0.005 mol/L to 0.015 mol/L of the aforementioned hydroxyalkylsulfonic acid or salt thereof. If the content is less than 0.001 mol/L, the gold deposition rate will be slower, while more than 0.1 mol/L is undesirable because of the greater likelihood of bath decomposition and plating irregularities.

Examples of the amine compound include compounds having primary and secondary amines in one molecule such as diethylenetriamine, triethylenetetramine, tetraethylenepentamine, pentaethylenehexamine, monoamine compounds such as methylamine, ethylamine, propylenamine, butylenamine, pentanamine, hexanamine, and diamine compounds such as diaminemethylenediamine, ethylenediamine, propylenediamine, butylenediamine, pentanediamine and hexanediamine.

Other examples include aromatic amines having an aromatic ring such as a benzene ring or other bound to the aforementioned compounds, and aromatic amine compounds such as aniline having directly-bound amino groups. Other examples include aminocarboxylic acids such as glycine and alanine.

Moreover, compounds having a high-polarity substitutional group such as a hydroxyl group, a carboxyl group or a sulfonic acid group bound to the aforementioned compounds or compounds forming a salt such as hydrochlorides can also be used to improve the solubility in water.

The content of the amine compound in the plating liquid is preferably 0.0005 mol/L to 0.2 mol/L or more preferably 0.003 mol/L to 0.03 mol/L. If the content is less than 0.0005 mol/L, the deposition rate will be slower, while more than 0.2 mol/L is not desirable because the bath becomes unstable.

Moreover, sodium dihydrogen phosphate, sodium borate or the like may be added as necessary to the electroless gold plating liquid of the present invention as a pH buffer.

In addition, the plating liquid of the present invention can also contain an aminocarboxylic acid compound or a carboxylic acid compound as a complexing agent in addition to the aforementioned mixed complexing agent. Examples of aminocarboxylic acid compounds include ethylenediaminetetraacetic acid (EDTA), hydroxyethylethylenediaminetriacetic acid, dihydroxyethylethylenediamine diacetic acid, propanediamine tetraacetic acid, diethylenetriamine pentaacetic acid, triethylenetetramine hexacetic acid, glycine, glycylglycine, glycylglycylglycine, dihydroxyethylglycine, iminodiacetic acid, hydroxyethyliminodiacetic acid, nitrilotriacetic acid, nitrilotripropionic acid, or alkali metal salts, alkali earth metal salts or ammonium salts thereof and the like. Rochelle salt and the like are also examples of carboxylic acid compounds.

It is desirable from the standpoint of gold deposition rate, plating coat appearance and bath stability that the pH of the gold plating liquid of the present invention be 5 to 9, and a pH of 6 to 8 is particularly desirable.

Alkaline compounds such as potassium hydroxide, sodium hydroxide and ammonia, and acid compounds such as sulfuric acid and phosphoric acid can be used to adjust the pH.

It is desirable from the standpoint of bath stability and gold deposition rate that the gold plating liquid of the present invention be used at a bath temperature of 60 to 90° C.

When plating with the gold plating liquid of the present invention, the material to be plated, such as a printed circuit board, is dipped in the bath. The material to be plated has preferably first been plated with a nickel undercoat or a subsequently displaced gold coat, and when plating is performed by using the gold plating liquid of the present invention, an adequate deposition rate for practical use is obtained, and the resulting gold plate coat has a good appearance. Plating liquid stability, which was a problem in the past, is also excellent.

EXAMPLES

Preferred embodiments of the present invention are explained with the following examples and comparative examples.

As shown in Table 1 below, a 70 μm thick rolled copper foil (glossy on both sides, total area 15.8 $cm^2$) which is used as the test piece is immersed for 5 minutes at about 45° C. in PB-242D acidic degreaser (made by Nikko Metal Plating K.K.) to remove oxides and organic substances such as a rolling oil which might be adhering somewhat to the surface of the copper foil. Next, it is immersed for 1 minute in 50° C. hot water to efficiently remove the acidic degreaser from the copper foil, and then water washed for about 1 minute. It is then immersed for 45 seconds at about 25° C. in a sodium persulfate solution (sodium persulfate 100 g/L, 96% sulfuric acid 20 mL/L) to bare a fresh copper foil surface, and water washed for 1 minute. Then it is dipped for 2 minutes at room temperature in a sulfuric acid solution (96% sulfuric acid 30 mL/L), and water washed for 1 minute. It is then dipped for 30 seconds at about 25° C. in a hydrochloric acid solution (35% hydrochloric acid 100 mL/L) to prevent sulfuric acid contamination.

This is then immediately immersed for 2 minutes at about 25° C. in KG-522 Pd activator liquid (made by Nikko Metal Plating K.K.), and water washed for 1 minute. It is then immersed for 10 seconds at about 25° C. in a sulfuric acid solution (96% sulfuric acid 30 mL/L) to prevent contamination by the Pd activator liquid, and water washed for 1 minutes. Electroless nickel plating (using KG-530 made by Nikko Metal Plating K.K.) is then performed for 20 minutes at 90° C. to prevent oxidation of the copper foil surface, depositing nickel to a thickness of about 7 μm on both surfaces of the copper foil. This is then water washed for 1 minute, and dipped for 20 minutes at 80° C. in CF-500S electroless displacement plating liquid which doesn't cause pin hole corrosions on the nickel plated surface (made by Nikko Materials K.K.) to deposit gold to a thickness of 0.05 μm on the nickel surface. This is then water washed for 1 minute, and electroless gold plating of the present invention is performed. Drying before and after electroless gold plating is done for the purpose of measuring the thickness of the gold plate by the weighing method, and is not necessary for actual processing.

The measuring methods and evaluation methods adopted in the electroless plating methods of the following examples and comparative examples are as follows.

Method of Measuring Plating Rate

The weights of the test piece before and after the electroless gold plating test were measured with an electronic force balance capable of measuring to 0.1 mg, and the thickness of the gold was calculated. The calculation formula is as follows:

$$\text{Gold thickness } (\mu m) = (\text{final weight } (g) - \text{initial weight } (g)) \times 10{,}000\ (\mu m/cm) \div \text{density of gold } (19.3\ g/cm^3) \div \text{area } (15.8\ cm^2).$$

Method of Evaluating Appearance

Color, irregularities and luster were evaluated visually after the plating test. The color of the test piece after plating was judged to be gold if it had a gold color with the deep metal luster of gold based on the color after electroless displacement gold plating. It was not considered gold if it exhibited any brown or reddish color, but was instead described as yellow-brown or reddish-yellow for example. Gold was the only color seen in the current test results.

The presence or absence of irregularities was evaluated at least as strictly as color judgment. The rolled copper foil already had some irregularities, and irregularities due to electroless nickel plating and electroless displacement gold plating were also distinguished when observing. However, there were judged to be no irregularities in all cases in the current test results.

The test pieces after electroless displacement gold plating exhibited luster, and based on this standard it was judged to be no luster in the observation if the luster was inferior to this, but in the present test results there was luster in all cases.

Liquid Color

The color of the plating liquid was evaluated with the naked eye immediately after completion of the electroless gold plating test. The electroless gold plating liquids of the present invention were clear but, after, the test one appeared slightly bluish.

Bath Decomposition

Immediately after finishing the electroless gold plating test the test piece was removed from the container, the container was wrapped in wrapping film and stored for a day and a night at the test temperature (70 to 85° C.), and after the removal of the film, the occurrence of abnormal gold deposition in the container was examined. As a result, abnormal gold deposition starting from a flaw in the container was seen only in Comparative Example 1. Under the other test conditions, no abnormal gold deposition was observed despite severe storage conditions.

Preparation and Testing of Electroless Gold Plating Liquids

Comparative Examples 1 & 2

Plating liquids whose compositions are shown in Table 2 were prepared.

The characteristic differences of Comparative Example 1 were that the plating liquid contained ethylenediamine as a reaction promoter and 8 g/L of hydroquinone as a reducing agent. The plating rate was fast, 0.96 μm/H, but the bath decomposed.

In Comparative Example 2, the bath composition comprised ethylenediamine as a reaction promoter but no reducing agent. Although there was no bath decomposition, the plating rate was 0.45 μm/H, the slowest speed in Tables 2 and 3.

Examples 1 through 3

In Example 1 in Table 2, the plating liquid comprised sodium hydroxymethanesulfonate as a reducing agent added to the composition of Comparative Example 2. The plating rate was 0.63 μm/H, times that of Comparative Example 2. The bath did not decompose and was extremely stable.

In Example 2 in Table 3, the composition was the same as Example 1 but the bath temperature was 85° C. The plating rate was 0.82 μm/H, 1.82 times that of Comparative Example 2. Even with the bath temperature raised to 85° C. the bath did not decompose and was extremely stable.

In the bath composition of Example 3, the reducing agent was the same sodium hydroxymethanesulfonate as in Example 1, but glycine was substituted for ethylenediamine as the reaction promoter. The plating rate was 0.64 μm/H, approximately the same as in Example 1, and no bath decomposition occurred. Glycine can be used equally as ethylenediamine as a reaction promoter.

TABLE 1

| Patent Examples | | | | |
|---|---|---|---|---|
| | Test piece: Cu foil | | | |
| Test procedure Process | Chemicals | | Conditions | Processing time |
| (1) Acid degreasing | PB-242D | | 40-50° C. | 5 min |
| Hot water wash | | | 50° C. | 1 min |
| Water wash | | | | |
| (2) Soft etching | Sodium persulfate | 100 g/L | 25° C. | 45 sec |
| | Sulfuric acid | 20 mL/L | | |
| Water wash | Sulfuric acid | 30 mL/L | | 2 min |
| Acid dip | | | | |
| Water wash | 35% HCl | 100 mL/L | 25° C. | 30 sec |
| HCl dip | | | | |
| (3) Activator | KG-522 | | 25° C. | 2 min |
| Water wash | | | | |
| Acid dip | | | | |
| Water wash | Sulfuric acid | 30 mL/L | 25° C. | 10 sec |
| (4) Electroless Ni—P plating | KG-530 | | 90° C. pH 4.5 | 20 min |
| Water wash | | | | |
| (5) Electroless gold displacement plating | CF-500S | | 80° C. pH 7.0 | 20 min |
| Water wash | | | | |
| Drying | | | | |
| Initial weighing | | | | |
| (6) Electroless gold reduction plating | Test | | 70-85° C. pH 7.0 | 60 min |
| Drying | | | | |
| Final weighing | | | | |

TABLE 2

| Test | | | Comparative Example 1 | | Comparative Example 2 | | Example 1 | |
|---|---|---|---|---|---|---|---|---|
| Composition | | Molecular weight | g/l | mol/l | g/l | mol/l | g/l | mol/l |
| Sodium gold sulfite | $Na_3Au(SO_3)_2$ | 426.06 | 4 as Au | 0.02 | 4 as Au | 0.02 | 4 as Au | 0.02 |
| EDTA-2Na | $C_{10}H_{14}N_2O_8Na_2 \cdot 2H_2O$ | 372.24 | 80 | 0.215 | 80 | 0.215 | 80 | 0.215 |

TABLE 2-continued

| Test | | | Comparative Example 1 | | Comparative Example 2 | | Example 1 | |
|---|---|---|---|---|---|---|---|---|
| Composition | | Molecular weight | g/l | mol/l | g/l | mol/l | g/l | mol/l |
| Potassium sodium tartrate | $C_4H_4KNaO_6 \cdot 4H_2O$ | 282.22 | 26 | 0.092 | 26 | 0.092 | 26 | 0.092 |
| Ethylenediamine | $NH_2CH_2CH_2NH_2$ | 60.1 | 2.5 | 0.042 | 2.5 | 0.042 | 2.5 | 0.042 |
| Glycine | $NH_2CH_2COOH$ | 75.1 | 0 | 0.000 | 0 | 0.000 | 0 | 0.000 |
| HMSNa | $HOCH_2SO_3Na$ | 138.12 | 0 | 0.000 | 0 | 0.000 | 1.4 | 0.010 |
| Sodium sulfite | $Na_2SO_3$ | 126.04 | 45 | 0.357 | 45 | 0.357 | 45 | 0.357 |
| Sodium thiosulfate | $Na_2S_2O_3$ | 158.11 | 5.5 | 0.035 | 5.5 | 0.035 | 5.5 | 0.035 |
| Hydroquinone | $C_6H_4(OH)_2$ | 110.11 | 8 | 0.073 | 0 | 0.000 | 0 | 0.000 |
| pH | | | 7 | | 7 | | 7 | |
| Bath temp. | ° C. | | 70 | | 80 | | 80 | |
| Plating rate | μm/H | | 0.960 | | 0.450 | | 0.630 | |
| Appearance | | | | | | | | |
| Color | | | Gold | | Gold | | Gold | |
| Irregularities | | | None | | None | | None | |
| Luster | | | Yes | | Yes | | Yes | |
| Liquid color | | | Clear | | Clear | | Clear | |
| Bath decomposition | | | Yes | | None | | None | |

TABLE 3

| Test | | | Example 2 | | Example 3 | |
|---|---|---|---|---|---|---|
| Composition | | Molecular weight | g/l | mol/l | g/l | mol/l |
| Sodium gold sulfite | $Na_3Au(SO_3)_2$ | 426.06 | 4 as Au | 0.02 | 4 as Au | 0.02 |
| EDTA-2Na | $C_{10}H_{14}N_2O_8Na_2 \cdot 2H_2O$ | 372.24 | 80 | 0.215 | 80 | 0.215 |
| Potassium sodium tartrate | $C_4H_4KNaO_6 \cdot 4H_2O$ | 282.22 | 26 | 0.092 | 26 | 0.092 |
| Ethylenediamine | $NH_2CH_2CH_2NH_2$ | 60.1 | 2.5 | 0.042 | 0 | 0.000 |
| Glycine | $NH_2CH_2COOH$ | 75.1 | 0 | 0.000 | 7.5 | 0.100 |
| HMSNa | $HOCH_2SO_3Na$ | 138.12 | 1.4 | 0.010 | 1.4 | 0.010 |
| Sodium sulfite | $Na_2SO_3$ | 126.04 | 45 | 0.357 | 45 | 0.357 |
| Sodium thiosulfate | $Na_2S_2O_3$ | 158.11 | 5.5 | 0.035 | 5.5 | 0.035 |
| Hydroquinone | $C_6H_4(OH)_2$ | 110.11 | 0 | 0.000 | 0 | 0.000 |
| pH | | | 7 | | 7 | |
| Bath temperature | ° C. | | 85 | | 80 | |
| Plating rate | μm/H | | 0.820 | | 0.640 | |
| Appearance | | | | | | |
| Color | | | Gold | | Gold | |
| Irregularities | | | None | | None | |
| Luster | | | Yes | | Yes | |
| Liquid color | | | Clear (faint blue) | | Clear | |
| Bath decomposition | | | None | | None | |

By using the electroless gold plating liquid of the present invention, the plating liquid is extremely stable and the deposition rate is adequate for practical use.

The invention claimed is:

1. An electroless gold plating liquid comprising a non-cyanide gold salt as a gold salt, an alkali metal salt or an ammonium salt of sulfurous acid and thiosulfuric acid as a complexing agent for gold, a hydroxyalkylsulfonic acid or a salt thereof represented by the following general formula as a reducing agent, and an amine compound,

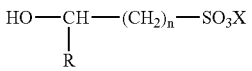

wherein R represents hydrogen, a carboxyl group, or any of a phenyl group, a tolyl group, a naphthyl group, a saturated or unsaturated alkyl group, an acetyl group, an acetonyl group, a pyridyl group and a furyl group which may have a substitutional group, X represents any of hydrogen, Na, K, and NH4, and n is an integer between 0 and 4.

2. An electroless gold plating liquid according to claim 1, wherein the reducing agent represented by said general formula is sodium hydroxymethanesulfonate.

3. An electroless gold plating liquid according to claim 1, wherein the non-cyanide gold salt is sodium gold sulfite.

4. An electroless gold plating liquid according to claim 1, wherein said amine compound is ethylenediamine or glycine.

* * * * *